US008813961B2

(12) United States Patent
Liao

(10) Patent No.: US 8,813,961 B2
(45) Date of Patent: Aug. 26, 2014

(54) AUTOMATICALLY RETRACTING CUSHIONING DEVICE

(75) Inventor: Yaw-Shin Liao, New Taipei (TW)

(73) Assignee: Air-Bag Packing Co., Ltd., New Taipei (TW)

( * ) Notice: Subject to any disclaimer, the term of this patent is extended or adjusted under 35 U.S.C. 154(b) by 0 days.

(21) Appl. No.: 13/546,251

(22) Filed: Jul. 11, 2012

(65) Prior Publication Data

US 2013/0129259 A1 May 23, 2013

(30) Foreign Application Priority Data

Nov. 23, 2011 (TW) ..... 100142941 A

(51) Int. Cl.
*B65D 81/02* (2006.01)
*B65D 81/05* (2006.01)

(52) U.S. Cl.
CPC ..... *B65D 81/052* (2013.01)
USPC ..... 206/522; 383/3

(58) Field of Classification Search
CPC ..... B65D 51/052
USPC ..... 206/521, 522, 591, 592, 594; 383/3
See application file for complete search history.

(56) References Cited

U.S. PATENT DOCUMENTS

| | | | | |
|---|---|---|---|---|
| 7,165,677 | B2 * | 1/2007 | Tanaka et al. | 206/522 |
| 7,533,772 | B2 * | 5/2009 | Yoshifusa et al. | 206/522 |
| 2002/0064319 | A1 * | 5/2002 | Tanaka et al. | 383/3 |
| 2005/0109656 | A1 * | 5/2005 | Ishizaki | 206/522 |
| 2006/0032779 | A1 * | 2/2006 | Tanaka et al. | 206/522 |
| 2007/0084745 | A1 * | 4/2007 | Yoshifusa | 206/522 |
| 2007/0090013 | A1 * | 4/2007 | Yoshifusa et al. | 206/522 |
| 2007/0295633 | A1 * | 12/2007 | Liao et al. | 206/522 |
| 2008/0314783 | A1 * | 12/2008 | Yoshifusa | 206/522 |
| 2009/0050509 | A1 * | 2/2009 | Liao et al. | 206/522 |
| 2009/0188830 | A1 * | 7/2009 | Liao et al. | 206/522 |

* cited by examiner

*Primary Examiner* — Luan K Bui
(74) *Attorney, Agent, or Firm* — Rabin & Berdo, P.C.

(57) ABSTRACT

An automatically retracting cushioning device includes a first air cylinder sheet, comprising a plurality of first air cylinders; a second cylinder sheet, in air communication with the first cylinder sheet, and comprising a plurality of second air cylinders; and a third air cylinder sheet, in air communication with the second air cylinder sheet, and comprising: a plurality of third air cylinders; and a plurality of retractable blocks, positioned on one end of the plurality of third air cylinders, and retracting the plurality of third air cylinders; wherein the third air cylinder sheet and the second air cylinder sheet are bent toward the first air cylinder sheet, allowing the third air cylinder sheet and the first air cylinder sheet to be approximately perpendicular to the second air cylinder sheet, thereby clamping an article.

9 Claims, 9 Drawing Sheets

AUTOMATICALLY RETRACTING CUSHIONING DEVICE

CROSS-REFERENCES TO RELATED APPLICATIONS

This non-provisional application claims priority under 35 U.S.C. §119(a) on Patent Application No. 100142941 filed in Taiwan, R.O.C. on 2011 Nov. 23, the entire contents of which are hereby incorporated by reference.

TECHNICAL FIELD

The present invention relates to a cushioning device, and more particularly to an automatically retracting cushioning device.

BACKGROUND

Currently, bubble paper or PVC is mostly used to cover an article when packing, but the cushioning effect is not good, easily resulting in article damage. To solve the bad cushioning effect in the prior art, an air packing bag made of a resin film is developed, which is hot-sealed to form airtight air cylinders, and configured with air filling entrances allowing air filling; the air packing bag can be used as a cushioning material in interior packaging after air is filled in the air cylinders through the air filling entrances.

In an air packing bag, a plurality of air cylinders are formed of check valves, and bendable nodes are configured on the air cylinders in advance, allowing bendable sides of an air cylinder sheet to be sealed forming a cushioning air bag for accepting an article, thereby providing a better cushioning packing structure for a cushioning material.

However, since an air packing bag available in the market must be tailor-made depending on the size of an article, it is very inconvenient and time-consuming. Certain portions of the air packing bag usually need to be extended or shortened if a common size thereof is adopted, and it is also inconvenient in use.

Furthermore, some air packing bags with a repeatedly liftable upper cover can be used again and again. However, if the packing bag is too large or too small for a packed article, article packing may be inadequate. Further, for example, air bags with a sealable opening must be destroyed if an article packed therein needs to be taken out after the opening is sealed; otherwise, it cannot be taken out. Such kinds of air bags are not only unfit or unsuitable for an improper size of article, but wasteful when used.

SUMMARY

To improve an air packing bag structure, allowing different shapes of different sizes of article to share the same air packing bag, and to be stored in different sizes of outer boxes while being packed, and further reducing the production cost thereof and using them repeatedly, the present invention is proposed.

The present invention proposes an automatically retracting cushioning device, including: a first air cylinder sheet, including a plurality of first air cylinders; a second air cylinder sheet, in air communication with the first air cylinder sheet and including a plurality of second air cylinders; a third air cylinder sheet, in air communication with the second air cylinder sheet and including a plurality of third air cylinders; and a plurality of retractable blocks, positioned on one end of the third air cylinder; wherein the third air cylinder sheet and the second air cylinder sheet bent toward the first air cylinder sheet allows the third air cylinder sheet and the first air cylinder sheet to be approximately perpendicular to the second air cylinder sheet, thereby clamping an article.

The retractable blocks may be positioned on one end of the first air cylinders, retracting the first air cylinders. Furthermore, the present invention further includes: a fourth air cylinder sheet, including a plurality of fourth air cylinders, and being in air communication with the third air cylinder sheet; bending the fourth air cylinder sheet allows the fourth air cylinder to be parallel approximately to the second air cylinder sheet. Consequently, the number of the fourth air cylinder sheets is two; bending the fourth air cylinder sheets allows the fourth air cylinder sheet to be moved further away from the third air cylinder sheet to be parallel approximately to the third air cylinder sheet and positioned at the same side as the first air cylinder sheet. In addition, the retractable blocks may further respectively positioned on the two ends of the third air cylinders, retracting the third air cylinders.

The present invention allows the air cylinder sheet to be retracted to a smaller size through the configuration of the retractable blocks so as to be able to match with various different sizes of articles, and be placed in various different sizes of boxes too, solving the problems of inadequate packing when an article is too large or too small in comparison with a conventional air bag, and when a packed article cannot be taken out, or a conventional air bag must be damaged, if the article needs to be taken out after an opening of the air bag is sealed.

BRIEF DESCRIPTION OF THE DRAWINGS

The present invention can be more fully understood by reference to the following description and accompanying drawings, in which.

DETAILED DESCRIPTION

Figure 1:
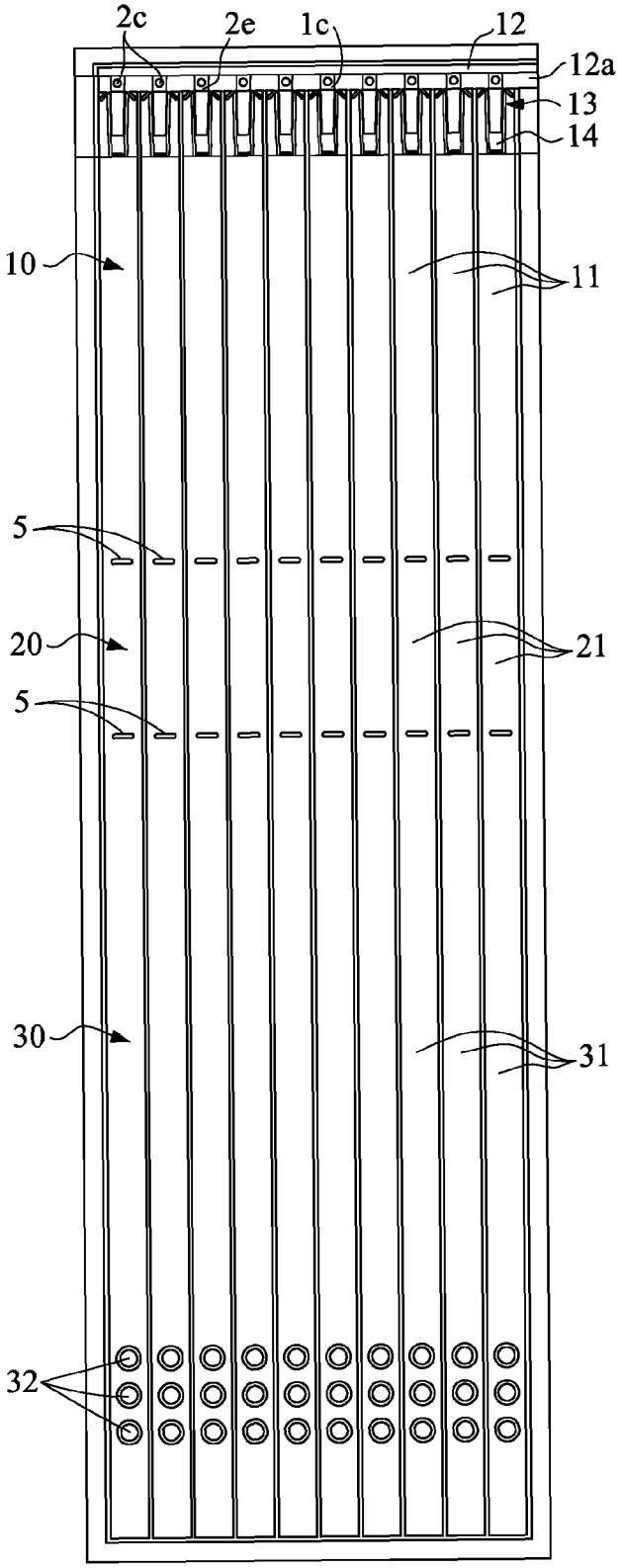
FIG. 1 is a planar view of an automatically retracting cushioning device of the present invention before air filling.
Figure 2:
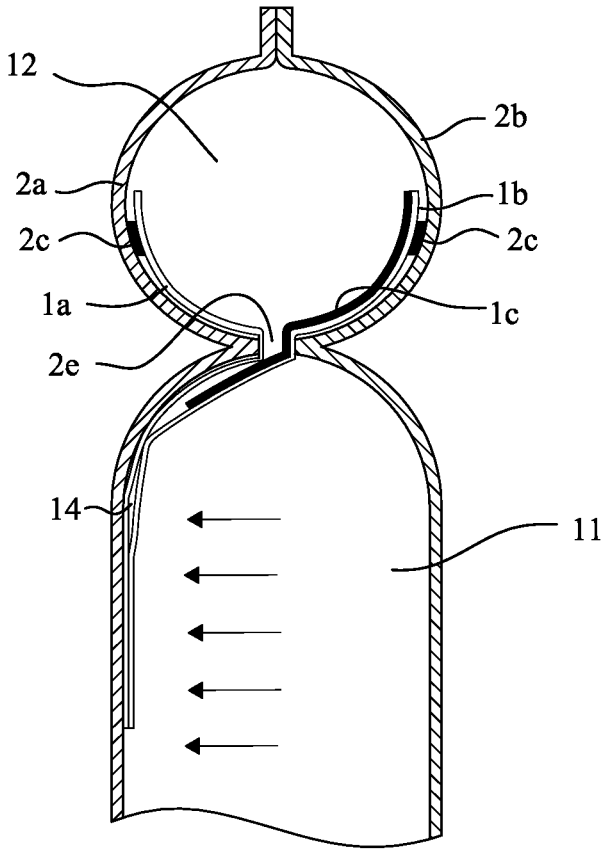
FIG. 2 is a cross sectional view of an automatically retracting cushioning device of the present invention after air filling.

Please refer to FIGS. 1 and 2, which illustrate an automatically retracting cushioning device of a first preferred embodiment according to the present invention. FIG. 1 is a planar view of an automatically retracting cushioning device of the present invention before air filling, and FIG. 2 is a cross sectional view of an automatically retracting cushioning device of the present invention after air filling. The automatically retracting cushioning device includes a first air cylinder sheet 10, second air cylinder sheet 20 and third air cylinder sheet 30.

The first air cylinder sheet includes a plurality of first air cylinders 11 and an air filling passageway 12, where the air filling passageway 12 is positioned side by side with one side of the plurality of first air cylinders 11, and used for filling air into the plurality of first air cylinders 11. In addition, the first air cylinder sheet 10 further includes a continuous check valve 13, allowing the air filling passageway 12 to be in air communication with the plurality of first air cylinders 11; the air in the air filling passageway 12 is filled into the plurality of air cylinders 11 through the continuous check valve 13, and the plurality of air cylinders 11 are then sealed through the continuous check valve 13, preventing the air in the plurality of air cylinders 11 from leaking.

The second air cylinder sheet 20 is connected to the first air cylinder sheet 10 in series at one side thereof and in air communication with the first air cylinder sheet 10. The second air cylinder sheet 20 includes a plurality of second air cylinders 21. Consequently, the second air cylinder 21 is shorter than the first air cylinder 11 with respect to the present embodiment, but the present invention is not limited to this to this.

The third air cylinder sheet 30 is connected in series with the second air cylinder sheet 20 at one side thereof and in air communication with the second air cylinder sheet 20. The third air cylinder sheet 30 includes a plurality of third air cylinders 31. Consequently, the third air cylinder 31 is longer than the second air cylinder 21, and preferably longer than the first air cylinder 11, but the present invention is not limited to this. In addition, the third air cylinder sheet 30 has a plurality of retractable blocks 32, respectively positioned on one side of each third air cylinder 31, where the retractable blocks 32 are formed by sticking two sheets of film 2*a*, 2*b* by means of hot sealing. Consequently, it is preferably not to stick a portion of area while hot-sealing the two sheets of film 2*a*, 2*b*, allowing each retractable block to be in air communication with others, but, the hot sealing used herein is only an example, the present invention is not limited to this.

Furthermore, the retractable blocks 32 positioned on the third air cylinder 31 preferably are nodes arranged distantly, i.e., a definite distance being kept among the retractable blocks 32 allows every retractable block 32 to be arranged distantly. The retractable blocks 32 on one end of each third air cylinder 31 numbers three, but the present invention is not limited to this; the retractable blocks 32 may further be arrange in vertical accumulation. Consequently, the retractable blocks 32 respectively on each two adjacent third air cylinders 31 are arranged in a corresponding configuration, allowing a definite distance to be kept among the retractable blocks 32 so that the retractable blocks 32 are arranged distantly and form approximately a checker-board-typed body. However, this is only an example; the present invention is not limited to this. Through the configuration of the retractable blocks 32, the adjacent retractable blocks 32 will bend the third air cylinders 31 automatically, causing them to be retracted, and thus reducing the ends thereof when the third air cylinder sheet 30 is pressed.

The first air cylinder sheet 10, second air cylinder sheet 20 and third air cylinder sheet 30 are preferably formed by sticking two sheets of outer film 2*a*, 2*b* together by means of hot sealing, and the air filling passageway 12 by sticking the two sheets of outer film 2*a*, 2*b* by means of hot sealing. Furthermore, the continuous check valve 13 is formed by sticking the two sheets of inner film 1*a*, 1*b* together by means of hot sealing. The two sheets of inner film 1*a*, 1*b* are positioned between the two sheets of outer film 2*a*, 2*b*, and hot sealing points 2*c* are yielded by means of hot sealing, thereby sticking the outer film 2*a* to the inner film 1*a* and outer film 2*b* to the inner film 1*b*. Furthermore, a plurality of air inlets 2*e* are formed between the two sheets of inner film 1*a*, 1*b* by not sticking the two sheets of inner film 1*a*, 1*b* together by means of hot sealing after a heat resistant material 1*c* is spread between the two sheets of inner film 1*a*, 1*b*, where each air inlet 2*e* corresponds to one first air cylinder 11. In addition, each air inlet 2*e* is connected to an air channel 14 formed between the two sheets of inner film 1*a*, 1*b* by sticking the two sheets of inner film 1*a*, 1*b* by means of hot sealing after the heat resistant material 1*c* is spread between the two sheets of inner film 1*a*, 1*b*.

Air will pull the two sheets of outer film 2*a*, 2*b* and the two sheets of inner film 1*a*, 1*b* apart outward after it enters an inflation inlet 12*a* to expand the air filling passageway 12. Consequently, the air flows into the first air cylinders 11 through the air channels 14 to cause the first air cylinder 11 to be filled with air and expanded. Thereafter, the internal air pressure in the first air cylinders 11 presses the two sheets of inner film 1*a*, 1*b* to attach to the outer film 2*a* or 2*b* tightly, covering the air channels 14 to seal the first air cylinders 11, thereby preventing the air in the first air cylinders 11 from leaking, and achieving an airtight effect.

Figure 3:
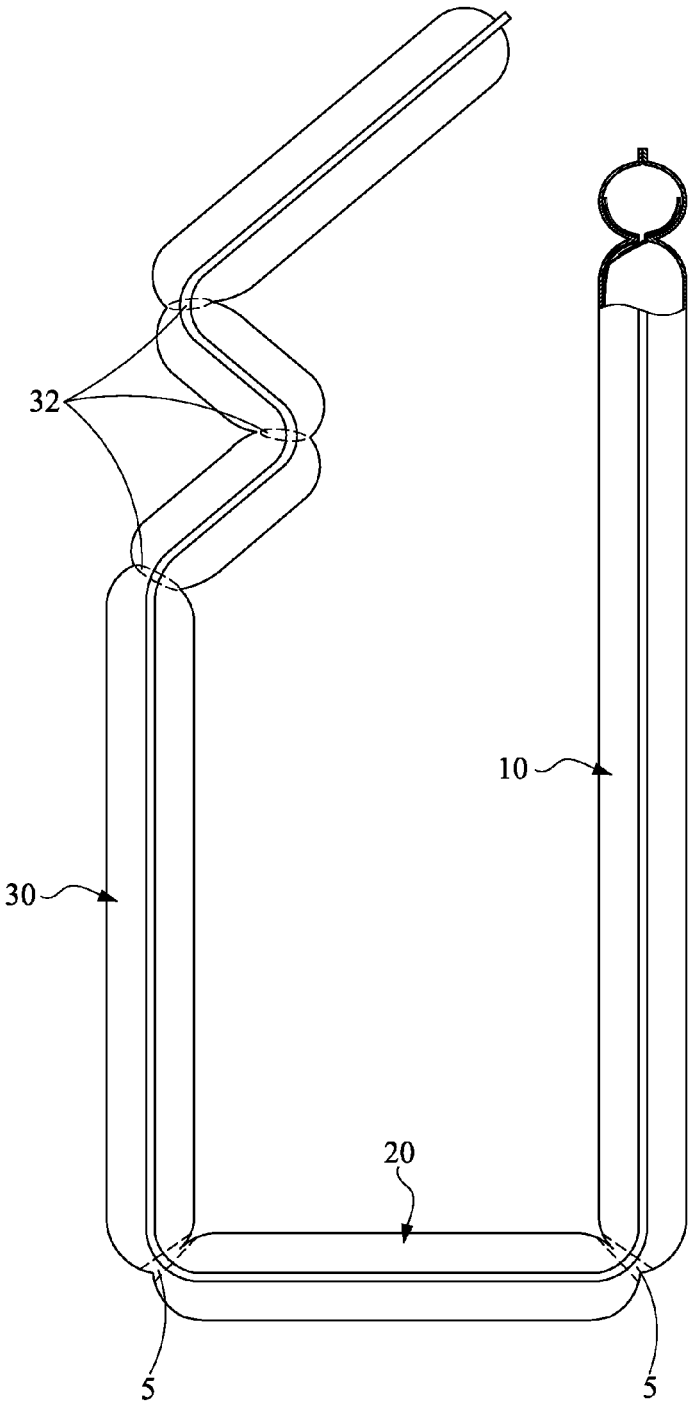
FIG. 3 is a schematic view of a first preferred embodiment according to the present invention while bent.

Please refer to FIG. 3, a schematic view of a first preferred embodiment of the present invention while bent. In addition, a plurality of bendable nodes 5 are respectively configured between the first air cylinder sheet 10 and the second air cylinder sheet 20, and between the second air cylinder sheet 20 and third air cylinder sheet 30, allowing the first air cylinder sheet 10, second air cylinder sheet 20 and the third air cylinder sheet 30 to be bended along the plurality of bendable nodes 5. In the present embodiment, the third air cylinder sheet 30 and the second air cylinder sheet 20 are bent toward the first air cylinder sheet 10, allowing the third air cylinder sheet 30 and the first air cylinder sheet 10 to be approximately perpendicular to the second air cylinder sheet 20 to form a U-typed body so as to clamp an article and provide cushioning protection. The third air cylinder sheet 30 bends at where the plurality of retractable blocks 32 is configured, and forms a triangle member. The reduction of interior angles of the triangle member leads the reduction of the third projecting length of the third air cylinder sheet 30, and the increase of the interior angles of the triangle member leads the increase of the third projecting length of the third air cylinder sheet 30.

Figure 4:
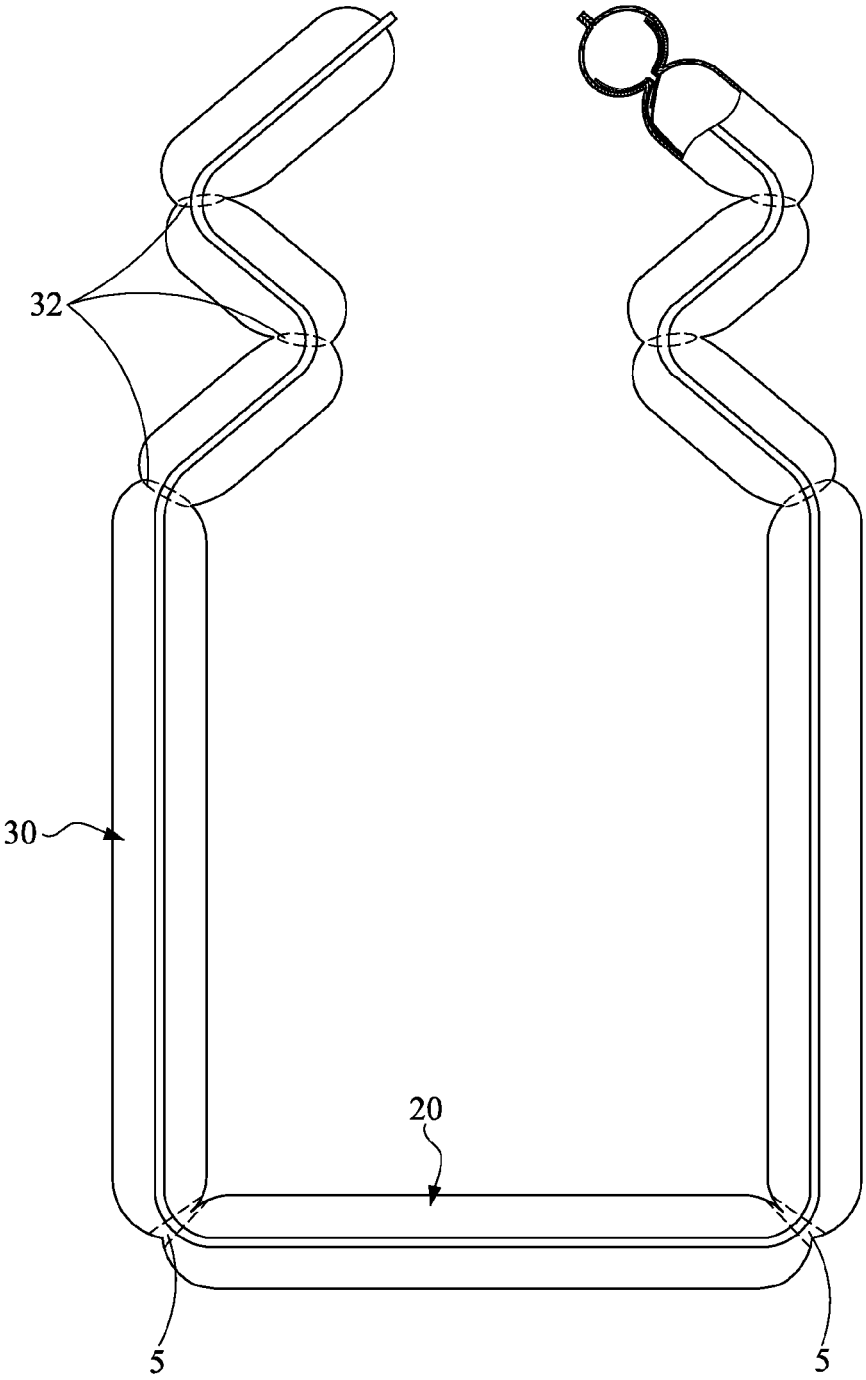
FIG. 4 is a schematic view of a second preferred embodiment according to the present invention while bent.

Please refer to FIG. 4, a schematic view of a second preferred embodiment according to the present invention while bent. Furthermore, the retractable blocks 32 may further be positioned on one end of the first air cylinders 11 for retracting the first air cylinder sheet 10. In the present invention, the positions of the retractable blocks 32 on the first air cylinders 11 preferably correspond to the positions of the retractable blocks 32 on the third, but the present invention is not limited to this. When the third air cylinder sheet 30 and the first air cylinder sheet 10 are approximately perpendicular to the second air cylinder sheet 20 forming approximately a U-typed body and the third air cylinders 31 are pressed, the third air cylinder sheet and the first air cylinder sheet 10 are retracted simultaneously so that an packed article can be clamped and provided with cushioning protection.

Figure 5:
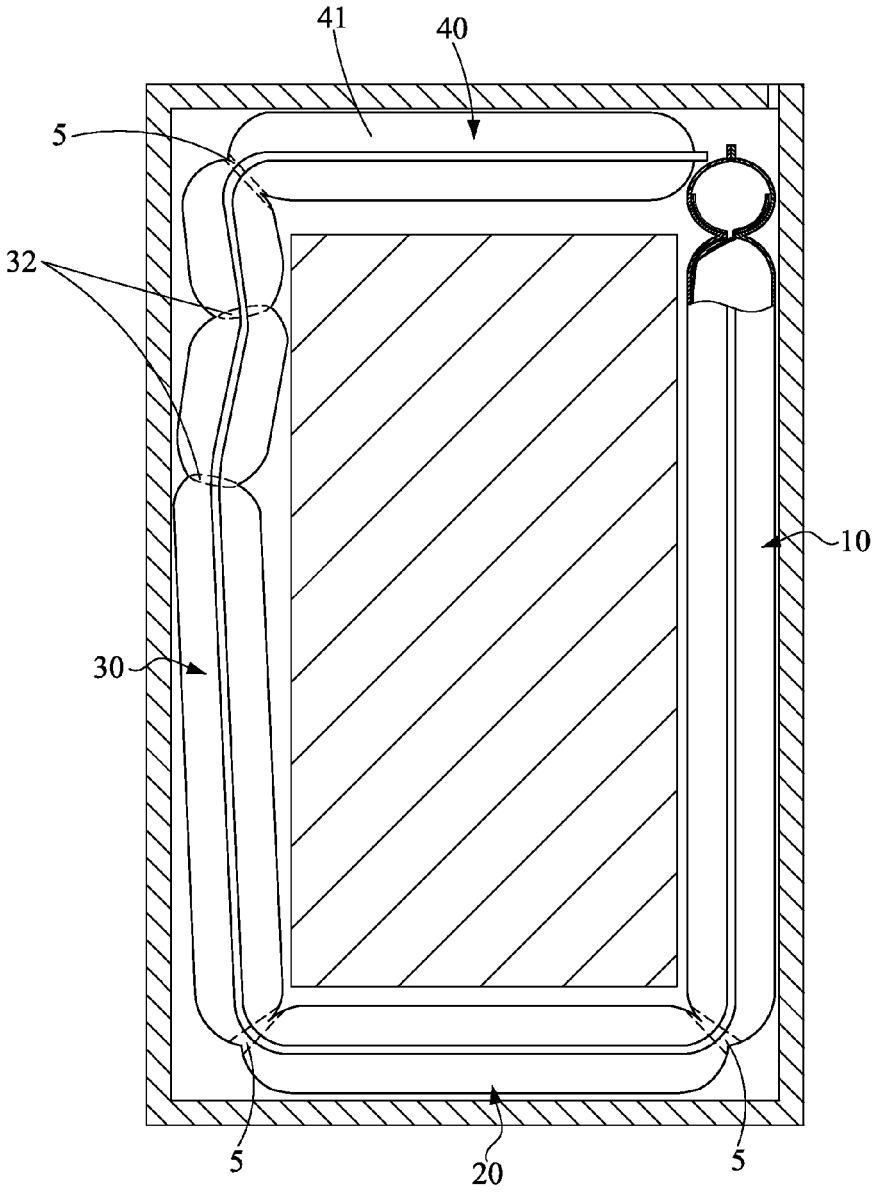
FIG. 5 is a schematic view of a third preferred embodiment according to the present invention while bent.

Please refer to FIG. 5, a schematic view of a third preferred embodiment of the present invention while bent. The automatically retracting cushioning device of the present invention further includes a fourth air cylinder sheet 40 connected in series to one side of the third air cylinder sheet 30 and in air communication with the third air cylinder sheet 30. The fourth air cylinder sheet 40 includes a plurality of fourth air cylinders 41. Consequently, in the present embodiment, the fourth air cylinder is almost as long as the second air cylinder 21, but the present invention is not limited to this. Furthermore, a plurality of bendable nodes 5 are also configured between the third air cylinder sheet 30 and the fourth air cylinder sheet 40. Consequently, the fourth air cylinder sheet 40 is further bent allowing the fourth air cylinder sheet 40 to be parallel approximately to the second air cylinder sheet 20, thereby clamping a packed article completely after the third air cylinder sheet 30 and the first air cylinder sheet 10 are bent to be approximately perpendicular to the second air cylinder sheet 20 to form a U-typed body approximately. The difference between the present embodiment and the previous embodiments is that the retractable blocks 32 on each third air cylinder 31 in the present embodiment preferably numbers three, but the present invention is not limited to this.

Figure 6:
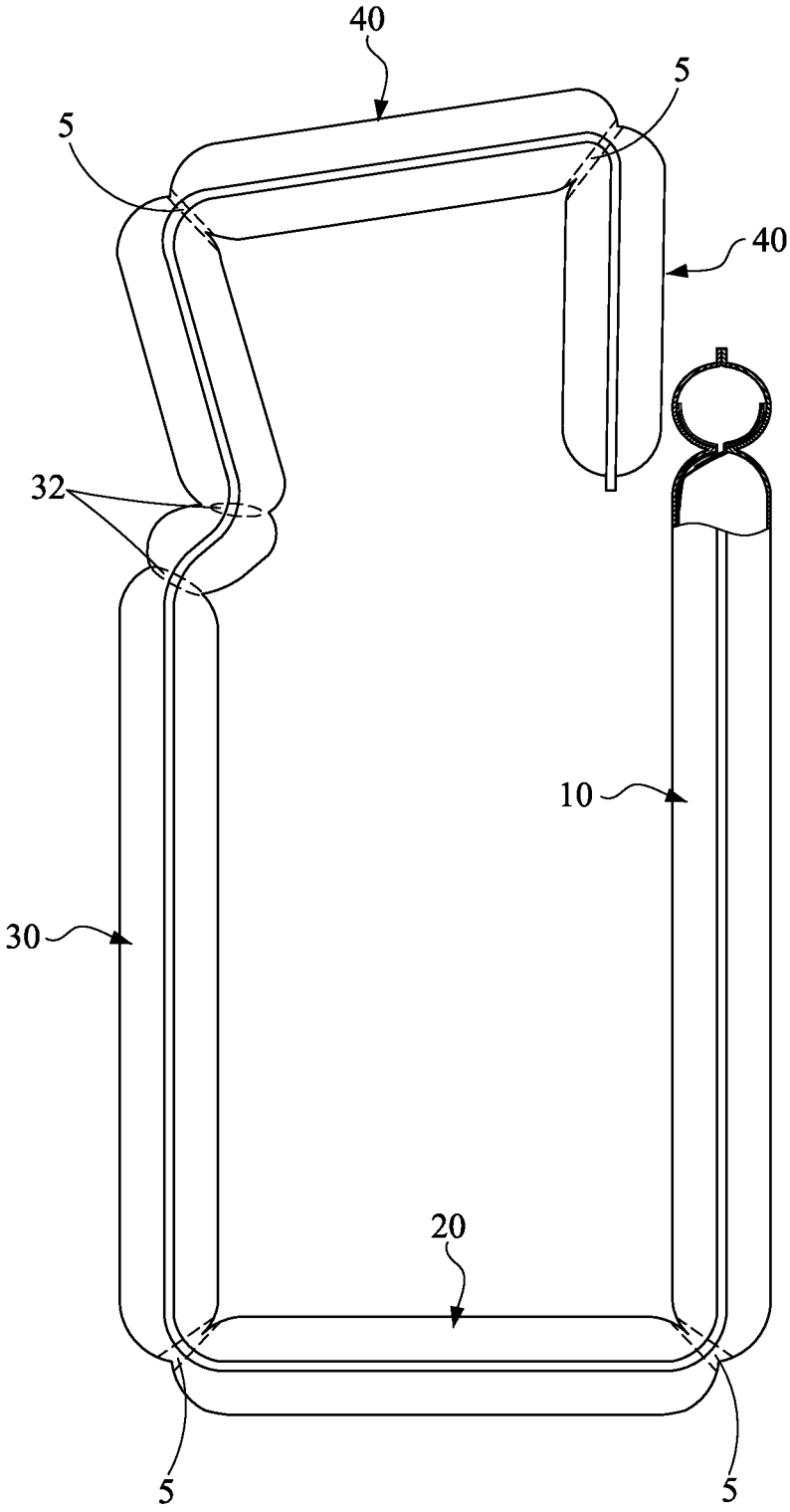
FIG. 6 is a schematic view of a fourth preferred embodiment according to the present invention while bent.
Figure 7:
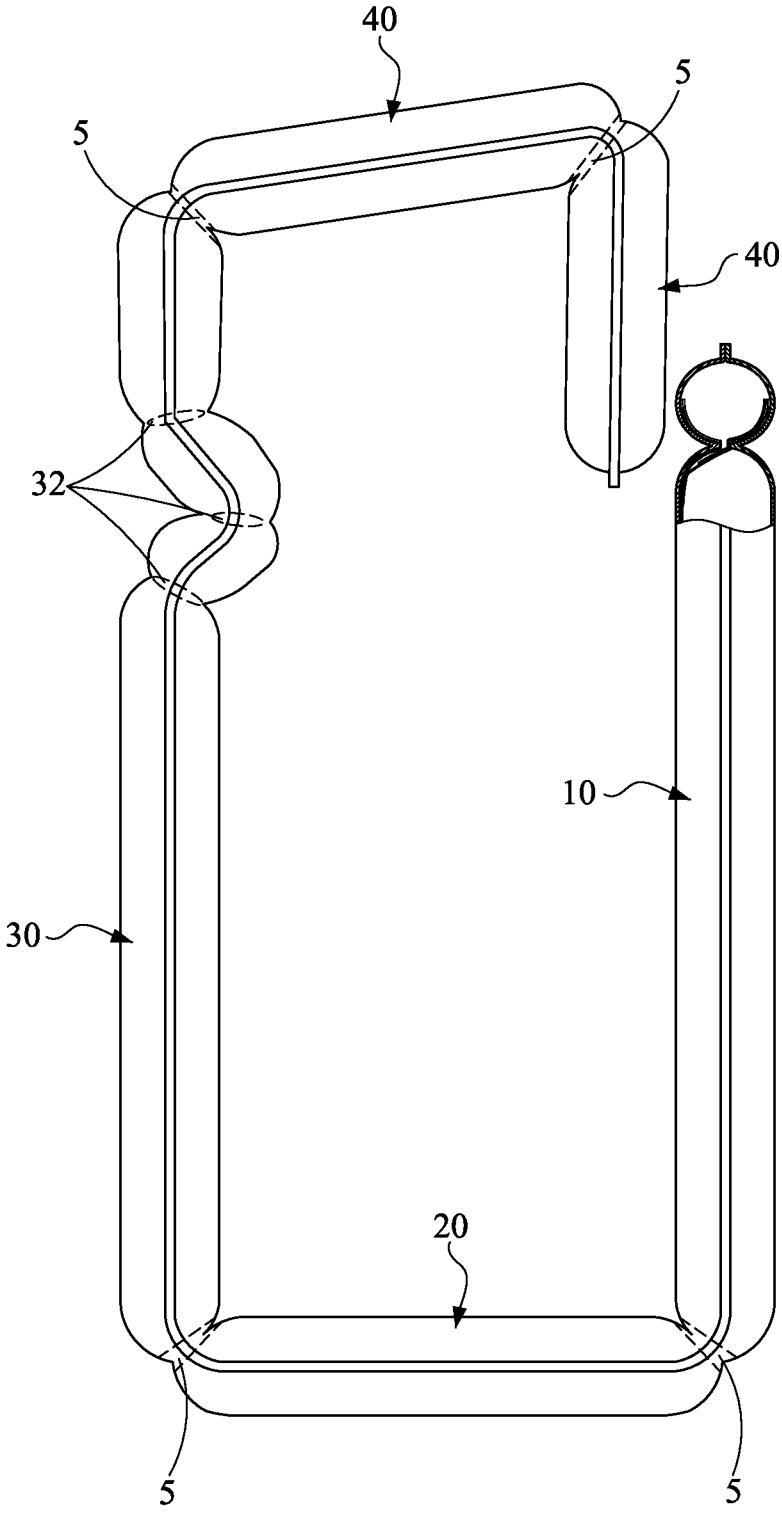
FIG. 7 is another schematic view of the fourth preferred embodiment according to the present invention while bent.

Please refer to FIGS. 6 and 7; FIG. 6 is a schematic view of a fourth preferred embodiment according to the present invention while bent and FIG. 7 is another schematic view of the fourth preferred embodiment according to the present invention while bent. The difference between the present embodiment and the third embodiment is that the fourth air cylinder sheets 40 of the present embodiment numbers two. Bending the fourth air cylinder sheets allows the fourth air cylinder sheet 40 distanced further away from the third air cylinder sheet 30 to be parallel approximately to the third air cylinder sheet 30 and be positioned at the same side as the first air cylinder sheet 10, thereby clamping a packed particle completely. Consequently, the retractable blocks 32 on each third air cylinder 31 in the present embodiment may number two or three, but the present invention is not limited to this.

Figure 8:
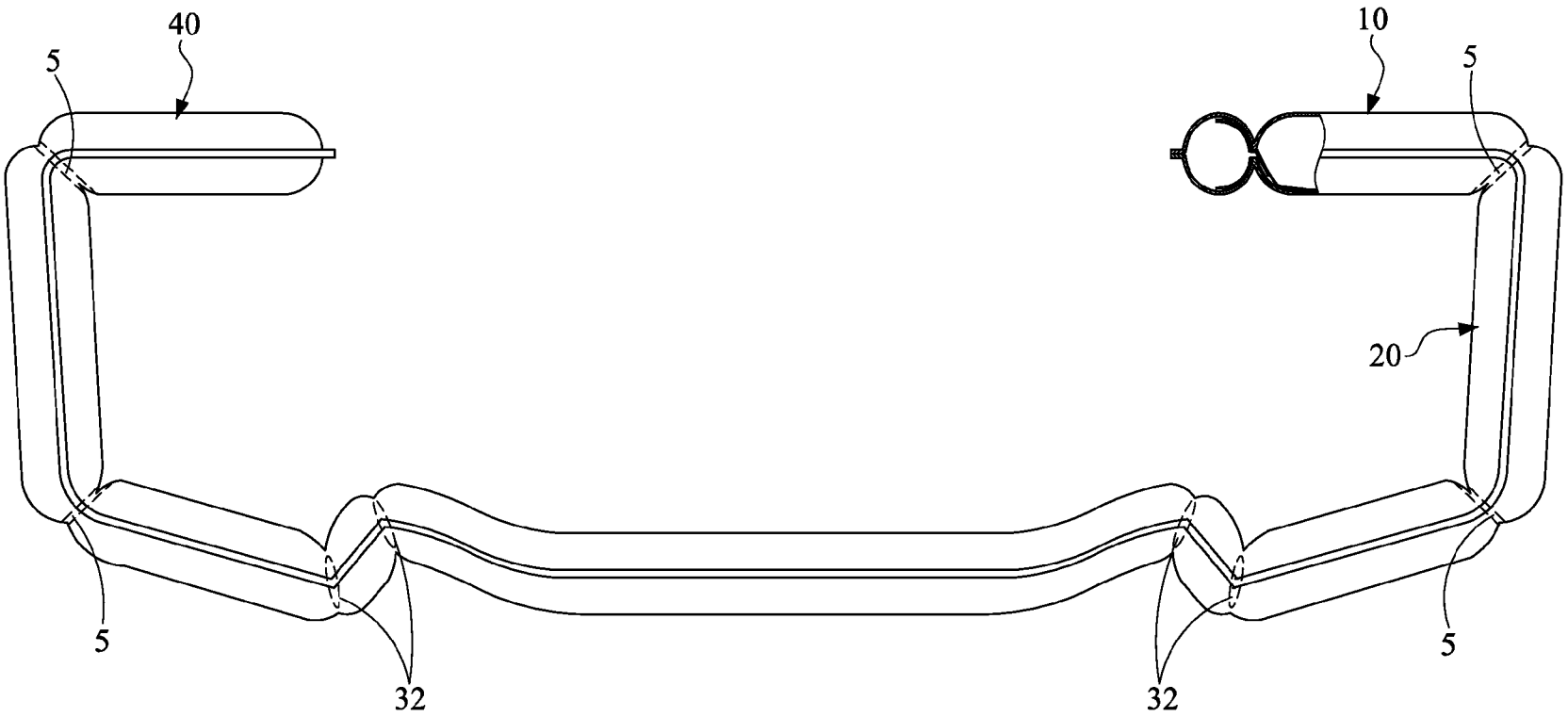
FIGS. 8 is a schematic view of a fifth preferred embodiment according to the present invention while bent.

Please refer to FIG. 8, a schematic view of a fifth preferred embodiment according to the present invention while bent. The difference between the present embodiment and the fourth embodiment is that retractable blocks 32 are respectively positioned on the two ends of each third air cylinder 31, retracting the third air cylinders 31. Consequently, the retractable blocks 32 on each end preferably number two, but the present invention is not limited to this. In addition, in the present invention the first air cylinder sheet 10 and the second air cylinder sheet 20 are almost as long as the two fourth air cylinder sheets 40, but the present invention is not limited to this.

Figure 9:
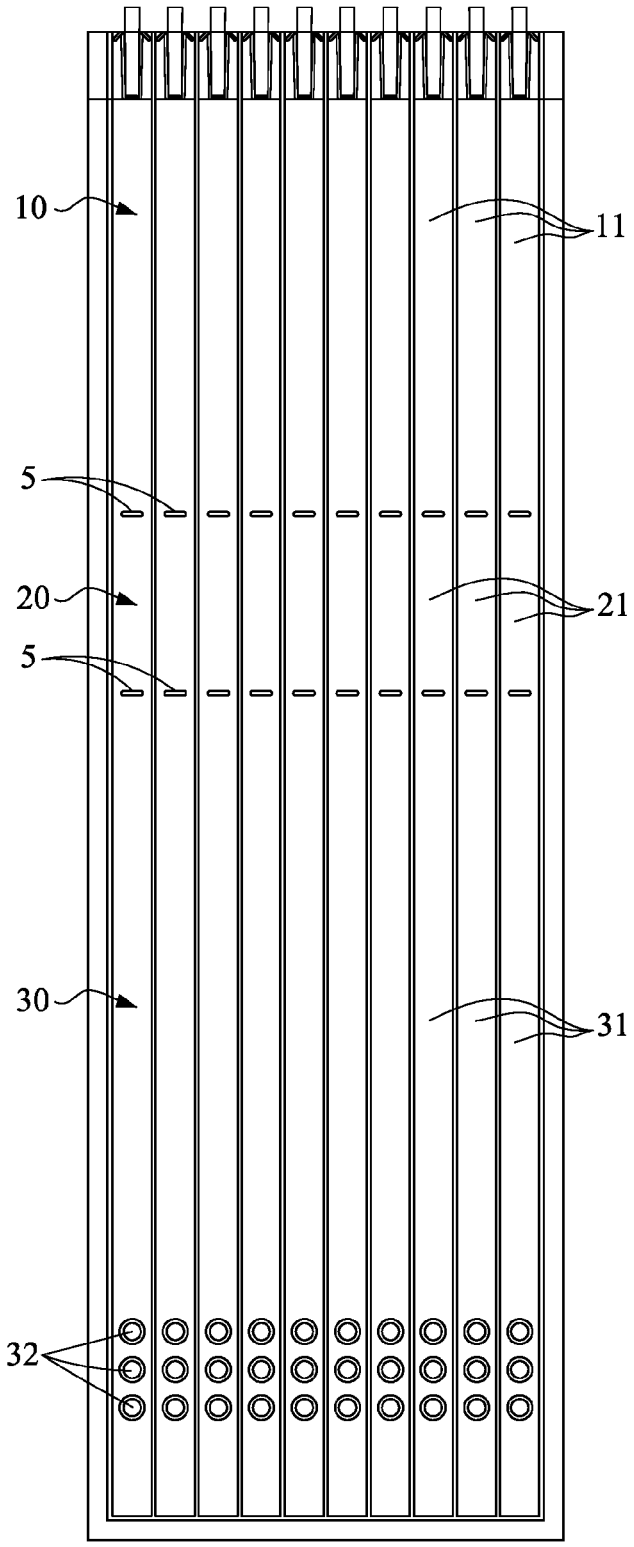
FIG. 9 is another planar view of an automatically retracting cushioning device of the present invention before air filling.

Please refer to FIG. 9, which illustrates a planar view of an automatically retracting cushioning device of another embodiment disclosed by the present invention. The difference between the present embodiment and the previous embodiments is that check valves are respectively configured on each first air cylinder 11. Consequently, air can be respectively filled into each first air cylinder 11 with respect to a particular requirement.

The air cylinder sheet can be retracted to a smaller size through the configuration of the retractable blocks of the present invention, solving the problems that the unfitted or unsuitable package happens when an article is too large or too small in comparison with a conventional air bag, and that a packed article cannot be taken out, or that a conventional air bag must be damaged if the article needs to be taken out after an opening of the air bag is sealed.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An automatically retracting cushioning device, formed by sticking two sheets of outer film, comprising:

a first air cylinder sheet, comprising a plurality of first air cylinders;

a second air cylinder sheet, in air communication with the first cylinder sheet, and comprising a plurality of second air cylinders;

a third air cylinder sheet, in air communication with the second air cylinder sheet, and comprising:

a plurality of third air cylinders;

a plurality of retractable blocks, formed by sticking the two sheets of outer film together by means of hot sealing, a portion of each of the plurality of retractable blocks being unstuck to allow each of the plurality of retractable blocks to be in air communication with other ones of the plurality of retractable blocks and the plurality of third air cylinders, and positioned on one end of the plurality of third air cylinders; a width of each respective retractable block being smaller than a width of a corresponding third air cylinder, and the retractable blocks being arranged vertically and horizontally in a checkerboard pattern; and a triangle member formed by a portion of the third air cylinder sheet, having interior angles;

a plurality of first bendable nodes, disposed between the first air cylinder sheet and the second air cylinder sheet, so that the second air cylinder sheet is bent toward the first air cylinder sheet along the plurality of first bendable nodes; and a plurality of second bendable nodes, disposed between the second air cylinder sheet and the third air cylinder sheet, so that the third air cylinder sheet is bent toward the second air cylinder sheet along the plurality of second bendable nodes, the first and the second bendable nodes causing the third air cylinder sheet and the first air cylinder sheet to be approximately perpendicular to the second air cylinder sheet, and the third air cylinder sheet to be approximately parallel to the first air cylinder sheet, and causing the third air cylinder sheet and the first air cylinder sheet to be located at different planes and respectively having a third projecting length and a first projecting length corresponding to a projecting axis parallel to the first and the third air cylinder sheet, wherein the third air cylinder sheet bends at where the plurality of retractable blocks is configured, a reduction of the interior angles of the triangle member leads the reduction of the third projecting length of the third air cylinder sheet, and an increase of the interior angles of the triangle member leads the increase of the third projecting length of the third air cylinder sheet, the interior angles of the triangle member and the length of third air cylinders are reduced when the third air cylinder sheet is pressed.

2. The automatically retracting cushioning device according to claim 1, further comprising an air filling passageway positioned on one side of the first air cylinder sheet, used fir filling air into the plurality of first air cylinders, and in air communication with the second and third air cylinder sheets.

3. The automatically retracting cushioning device according to claim 2, further comprising a continuous check valve, used fir being in air communication with the air filling passageway and the plurality of first air cylinders, air in the air filling passageway being filled into the plurality of first air cylinders through the continuous check valve, and the plurality of first air cylinders being then shielded through the continuous check valve, preventing the plurality of first air cylinder from leaking.

4. The automatically retracting cushioning device according to claim 1, further comprising a continuous check valve comprising:

two inner films, a heat resistant material being spread between the two inner films; and a plurality of air inlets, corresponding to the plurality of first air cylinders, formed at positions where the heat resistant material is spread by sticking the two inner films to each other by means of hot sealing.

5. The automatically retracting cushioning device according to claim 4, wherein the continuous check valve further comprises a plurality of air channels, connected to the plurality of air inlets.

6. The automatically retracting cushioning device according to claim 1, wherein the retractable blocks are further positioned on one end of the first air cylinders, thereby retracting the first air cylinders.

7. The automatically retracting cushioning device according to claim 1, further comprising a fourth air cylinder sheet, comprising a plurality of fourth air cylinders, in air communication with the third air cylinder sheet, bending the fourth air cylinder sheet, allows the fourth air cylinder sheet to be parallel approximately to the second air cylinder sheet.

8. The automatically retracting cushioning device according to claim 7, further comprising a plurality of third bendable nodes, positioned between the third air cylinder sheet and the fourth air cylinder sheet.

9. The automatically retracting cushioning device according to claim 7, further comprising a fifth air cylinder sheet distanced further away from the third air cylinder sheet than the fourth air cylinder sheet, wherein bending the fifth air cylinder sheet allows the fifth air cylinder sheet to be parallel approximately to the third air cylinder sheet, and positioned at the same side as the first air cylinder sheet.

* * * * *